US005368205A

United States Patent [19]

Groh

[11] Patent Number: 5,368,205

[45] Date of Patent: Nov. 29, 1994

[54] APPARATUS FOR CONTROLLING FOAMING AND FLOWRATE IN BEVERAGE DISPENSING SYSTEMS

[75] Inventor: James K. Groh, Lombard, Ill.

[73] Assignee: Banner Beverage Systems, Inc.

[21] Appl. No.: 94,471

[22] Filed: Jul. 19, 1993

[51] Int. Cl.[5] ..... B67D 1/00

[52] U.S. Cl. ..... 222/189; 222/564; 222/547; 251/127

[58] Field of Search ..... 222/146.6, 189, 564, 222/547, 400.7, 399; 137/550; 251/118, 127

[56] References Cited

U.S. PATENT DOCUMENTS

| | | | |
|---|---|---|---|
| 2,091,042 | 8/1937 | Hedges | 251/118 X |
| 2,331,834 | 10/1943 | Harr | 222/400.7 X |
| 2,345,840 | 4/1944 | Strong | 251/118 X |
| 2,401,914 | 6/1946 | DiPietro | 222/189 X |
| 2,746,641 | 5/1956 | King | 222/189 X |
| 2,899,170 | 8/1959 | Cornelius | 251/122 |
| 2,924,238 | 2/1960 | Cornelius | 137/600 |
| 3,084,718 | 4/1963 | Ash | 251/118 X |
| 3,373,937 | 3/1968 | Yuza | 222/564 X |
| 3,625,399 | 12/1971 | Heisler | 222/399 X |
| 4,402,485 | 9/1983 | Fagerlund | 251/127 X |
| 4,456,033 | 6/1984 | Kay et al. | 251/127 X |

FOREIGN PATENT DOCUMENTS

| | | | |
|---|---|---|---|
| 3707128 | 9/1988 | Germany | 222/564 |
| 330166 | 10/1935 | Italy | 251/118 |
| 9108978 | 6/1991 | WIPO | 222/564 |

OTHER PUBLICATIONS

The Perlick Company, Inc. Catalog No. 300, cover and pp. 22–25 circa Sep. 1989.

The Cornelius Company, catalog page and price list 1980.

The Cornelius Company, catalog page 1983.

*Primary Examiner*—Andres Kashnikow
*Assistant Examiner*—Anthoula Pomrening
*Attorney, Agent, or Firm*—Dick and Harris

[57] ABSTRACT

An apparatus for controlling foaming and flowrate in a beverage dispensing system, such as a draft beer dispensing system. A flow regulating member is positioned within a faucet member, at the delivery end of the beer dispensing system, to balance the dispensing system to, in turn, further prevent the break-up of the beverage into foam.

17 Claims, 1 Drawing Sheet

APPARATUS FOR CONTROLLING FOAMING AND FLOWRATE IN BEVERAGE DISPENSING SYSTEMS

BACKGROUND OF THE INVENTION

The present invention relates to beverage dispensing systems, and in particular, to systems for dispensing beverages which contain dissolved gases (e.g., carbonated beverages such as beer or soda), which are stored in kegs, and dispensed from faucets at locations more or less remote from the keg storage location.

Systems for the dispensing of beer are especially problematic. In a typical bar installation, the beer kegs are stored in a cooler in a basement or back room, vertically and/or horizontally remote from the dispensing location (bar). A number of beverage transport tubes extend from the kegs in the cooler to the bar, to a dispensing device to which the faucet or faucets are attached. A number of other tubes, carrying a coolant (glycol), are placed in a circuit from the cooler, substantially parallel to the beverage transport tubes, all the way to the faucets, and back to the cooler, so that the beer and the faucets are cooled. The two sets of tubes are typically encased together in a temperature isolating enclosure, and the assembly is often referred to as a "python".

The motive force which causes the beer to flow in such a system is pressurized gas. Most relatively small systems utilize carbon dioxide, which is supplied from pressurized cylinders. A pressure regulator, between the cylinder and the beer kegs, is nominally used to control the amount of pressure applied to the beer. In larger, or more extended systems, a mixture of gases (air and carbon dioxide) may be used, requiring the use of a compressor. Such mixed gases are also used when the pressure required in a carbon dioxide system, just to make the beer move, is so great that gas absorption will take place readily (as described in further detail hereinafter). Such mixed gas systems are complex and expensive.

A typical beer keg is configured so that the tube, through which the beer is withdrawn from the keg, has its opening adjacent the bottom of the keg. The pressurizing gas is inletted into the keg through an opening in the top of the keg, so that the pressurizing gas pushes "down" on the beer.

Optimally, a beer dispensing set-up, once established, will provide the cold beer at a desired flow rate of approximately one gallon per minute, with the beer leaving the faucet in a continuous, substantially completely liquid state. In order for a beer to "run" properly, the system must be configured so as to place a certain amount of "back" pressure (that is, resistance pressure) in the lines, when running. A typical desired range of back pressure is between nine and twenty-four pounds per square inch. However, each beer dispensing installation is an individual set-up, which must be calculated and laid out according to the customer's needs, and the structural limitations (e.g., run length) of the site.

It is often the situation that a dispensing set-up may often, almost immediately begin to have performance which departs significantly from that anticipated when the set-up is first installed. The back pressure will be or become substantially lower than anticipated, prompting the proprietor to raise the pressure of the propellant gas. This may have the result of producing an "over-rebound", in that the beer will then have too much propellant pressure, thus producing foam. Variations in the keg volume, or in the line or cooler temperature, may also adversely affect the flow of the beer, prompting the operator to attempt a quick solution by increasing the gas pressure.

Foam occurs when the beer is agitated, or when the beer passes quickly through a region of sudden, drastic pressure drop. In a typical beer dispensing faucet, the flow passageway widens suddenly where it joins the valve portion of the faucet. This area is often referred to as the "bellmouth". It is believed that if the beer is under too high a pressure as it approaches the bellmouth, the sudden increase in available volume upon entering the bellmouth so drastically lowers the pressure on the beer that the carbon dioxide which is dissolved in the beer comes out of solution, producing foam. Excess foam is perhaps the leading cause of wasted beer, and thus lost profits, from which a proprietor may suffer.

An additional problem which may result from the application of excessive propellant pressure (particularly carbon dioxide) applied to the beer kegs is that of absorption of the propellant gas into the beer. Once a particular keg has been tapped, and the propellant pressure is applied, the pressure is continuously applied, night and day, even when the establishment is closed. Over time, if the pressure is too great, and the consumption of the beer is slow enough, the beer will absorb more than a tolerable amount of gas, and the taste of the beer will be adversely affected, thus causing a particular keg to have to be changed prematurely, leading to additional waste.

The performance of a particular dispensing set-up may also be affected by the brand of beer which is being delivered. Some lighter beers are "fragile" and tend to break up into foam even over short distances, due to the pressure required to make them flow at all. Low alcohol beers are also difficult to make "run", that is, flow without foaming, since, by their nature, they do not hold carbon dioxide in solution well.

In addition to such "immediate" changes to performance, the performance of a dispensing set-up may degrade over time as a result of a number of factors. For example, the functioning of the cooler in which the kegs are stored may degrade, raising the beer temperature slightly, and increasing its propensity to break up. An increase of only 2–3 degrees F., insufficient to be otherwise noticed by a consumer, could lead to substantial losses to foaming. Damage to the transportation piping, caused by the application of caustic materials during required periodic cleaning, also can affect the performance of the dispensing system.

It is believed that such various difficulties as may arise in the operation of a delivery system may be remedied if there would be some way to elevate the back pressure (not the applied pressure) while slowing the volumetric flow rate, so as to control the tendency of the beer to foam.

Because the piping for a beer delivery system must be insulated along its route in order to prevent losses due to the absorption of heat, once a system has been installed, it may be unreasonably costly to gain access to the system components in order to modify the existing delivery system to add in back pressure, typically by adding length to the piping. Physical obstructions or flow diverters such as baffles, and the like, cannot be added mid-stream into the flow, as any such items may serve as sites for bubble nucleation, leading to foaming. Additional back pressure can thus only practically be added at the delivery end of the system, at the faucet.

Prior art attempts at providing apparatus for adding back pressure have typically comprised the integration of a flow regulator into the faucet, in the form of a piston, which is axially movable in the direction of the shank of the faucet. This piston may be covered with an elastomeric sheath so as present a relatively smooth surface to the beer flow, to prevent the formation of foam. The free end of the piston, which points upstream, may be formed as a tapered cylinder, or even as a cone, and will be actuated by a lever on the outside of the faucet. When actuated, the piston will move, so as to obstruct a greater or lesser amount of the flow passageway in the shank, to increase or decrease the effective cross-sectional area of the flow passageway. Faucets incorporating such devices are manufactured or have been manufactured in the past by such firms as Cornelius in Anoka, Minn., and Perlick in Milwaukee, Wis.

Faucets incorporating such devices have apparently generally not proved popular, though. The piston assembly adds significantly to the cost of the faucet, and, in addition, adds to the physical dimensions of the faucet, by greatly lengthening the shank portion, making such faucets too awkward, bulky, or simply too long to fit in many applications.

It is, accordingly, an object of the present invention, to provide an apparatus for controlling foaming and flowrate in a pressurized beverage dispensing system, such as a beer tapping system.

Another object of the invention is to provide an apparatus for controlling foaming, while otherwise improving performance of a beer tapping system, by providing additional back pressure to the system to "balance" the overall system.

A further object of the invention is provide such a foam control apparatus which additionally regulates the flowrate of the beverage being dispensed to additionally control and substantially preclude break up of the beverage during dispensing.

Still another object of the invention is to provide such a foam control device which may be readily added to a dispensing system, after the system has been originally installed, without requiring substantial disassembly of the system, or causing potentially destructive or disruptive uncovering of enclosed, sealed components of the system.

Yet still another object of the invention is to provide an apparatus for controlling foaming in beverage dispensing systems which may be readily and inexpensively fabricated and installed.

These and other objects of the invention will become apparent in light of the present specification, drawings and claims.

SUMMARY OF THE INVENTION

The present invention is an apparatus for substantially precluding foaming in a system for dispensing beverages having gases dissolved therein, in which the dispensing system includes source means for storing the beverage in a controlled environment, and at least one beverage transport member, operably associated with the source means, for transporting the beverage, under pressure, away from the source means of beverage. At least one faucet means will be operably associated with the at least one beverage transport member, for enabling delivery of the beverage into containers for consumption, and will include a shank portion, operably connected in fluid communication with the at least one beverage transport means, for receiving the beverage from the at least one beverage transport means and including a flow passageway; a valve portion, operably configured to be selectively positionable between open and closed configurations, to start and stop flow of the beverage through the beverage dispensing system; and a nozzle portion, for directing flow of the beverage into the containers.

A flow regulator means is operably disposed in the flow passageway, upstream from and substantially adjacent to the valve portion, for substantially precluding break-up of the beverage and release of the gases dissolved in the beverage, so as to prevent foaming.

In an embodiment of the invention, the flow regulator means comprises a substantially cylindrical coil, having an outer diameter advantageously configured so as to enable a slight forced fit, upon insertion of the flow regulator means into the flow passageway of the shank portion of the faucet means.

In a preferred embodiment of the invention, the flow regulator means comprises a mesh member, advantageously configured to fit within the flow passageway of the shank portion of the faucet means, with a slightly forced fit.

The mesh member may be fabricated from food grade stainless steel, preferably from a substantially rectangular piece of mesh material. In a preferred embodiment, the mesh member may have a wire thickness of 0.016 inches. The wires of the mesh material will form a pattern of squares, with a square count per linear inch in the range of 18 to 22 squares per linear inch. Twenty squares per linear inches is a preferred gauge of mesh material.

The flow regulator means further comprises handle means, operably emanating from an end of the coil, for facilitating removal of the flow regulator means from the flow passageway, and for substantially precluding overinsertion of the flow regulator means into the flow passageway. The handle means, in particular, is formed as a wire loop member, operably configured to form one of a plurality of particular geometric outlines, each outline corresponding to a particular combination of characteristics of the particular flow regulator means.

DETAILED DESCRIPTION OF THE DRAWINGS

Figure 1:
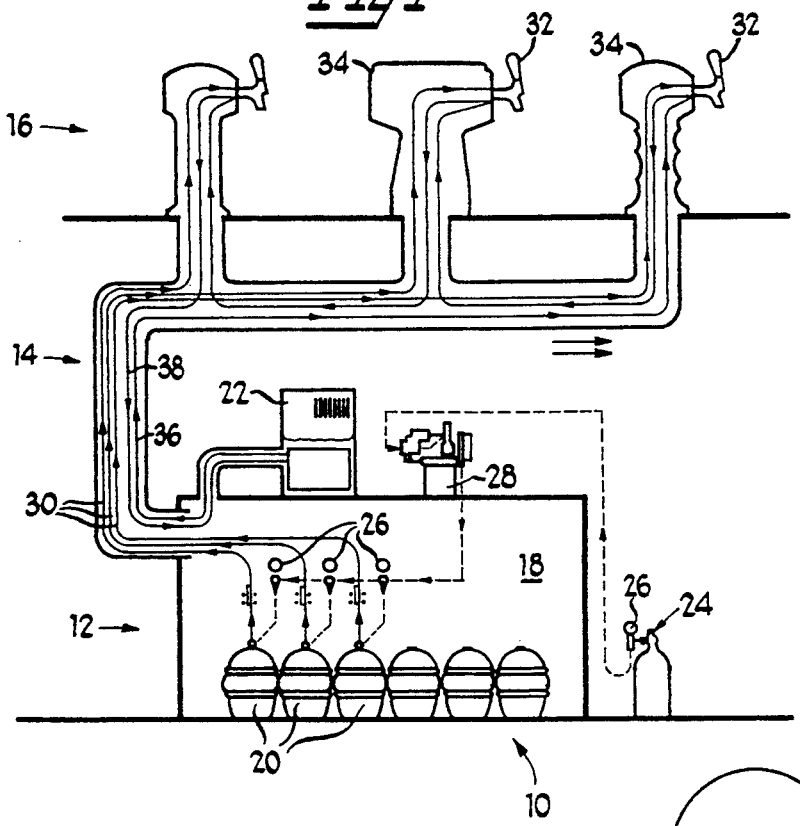
FIG. 1 is a schematic illustration of a typical beverage dispensing set-up.
Figure 3:
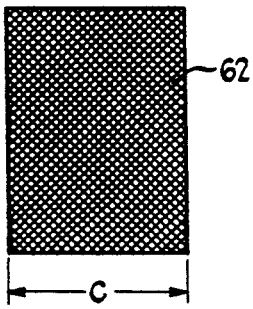
FIG. 3 is a plan view of a sheet of mesh material for forming the coil apparatus according to FIG. 2.

While this invention is susceptible of embodiment in many different forms, there is shown in the drawings and will be described in detail herein, a preferred embodiment, with the understanding that the present disclosure is to be considered as an exemplification of the principles of the invention, and is not intended to limit the invention to the embodiment illustrated.

FIG. 1 depicts, in partial schematic form, a typical beer dispensing set-up 10, which includes storage portion 12, transport portion 14 and delivery portion 16.

Delivery portion 10 of dispensing set-up 10 includes cooler 18, in which a number of beer kegs 20 are stored. Power plant 22 supplies cooling for the cooler 18, and additionally supplies coolant fluid for transport portion 14, in a manner described below. To propel the beer from kegs 20 through transport portion 14 to delivery portion 16, typically pressurized gas, in the form of carbon dioxide from cylinder 24, is directed into keg 20, through a pressure regulator 26. As mentioned previously, some systems inherently require greater propulsive power than carbon dioxide gas can effectively provide, so a compressor 28 may be used which mixes the bottled gas with ambient air, which passes through further regulators 26.

Tubes 30 lead from kegs 20 in a collected bundle (called a "python") in transport portion 14, to their respective faucets 32 in columns 34 in delivery portion 16. Delivery portion 16 may be located at a position quite removed from storage portion 12, at a substantial distance both horizontally and vertically. Accordingly, in order to keep the beer cold, palatable, and substantially liquid en route to the faucets, liquid coolant fluid, typically glycol, is transported in pipes 36, 38 to and from faucets 32 immediately adjacent to tubes 30. Transport portion or "python" 14 is thermally insulated, so as to prevent tubes 30, and pipes 36 and 38 from absorbing heat along their lengths.

Figure 2:
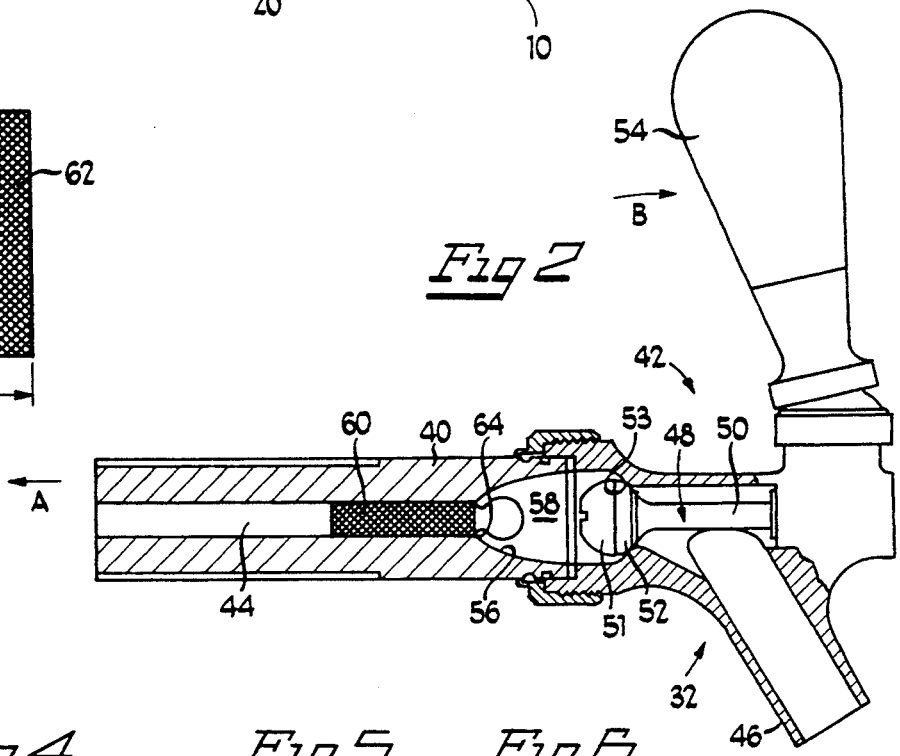
FIG. 2 is a side elevation, in partial section, of a typical dispensing faucet, showing the coil apparatus according to the present invention installed.
Figure 4:
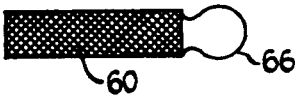
FIG. 4 is a side elevation of an coil apparatus according to the present invention.
Figure 5:
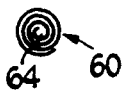
FIG. 5 is an end view of the coil apparatus according to FIG. 4.
Figure 6:
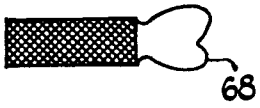
FIG. 6 is a side elevation of an alternative embodiment of the coil apparatus according to the present invention.

A typical beer faucet construction is shown in FIG. 2. Faucet 32, which is supported in a column (not shown) in a conventional manner, includes shank 40, and combined nozzle and valve portion 42. Shank 40 is connected to one of tubes 30 (not shown) in the direction of arrow A. Nozzle and valve portion 42 includes nozzle 46, valve member 48 with valve stem 50, head 51 and gasket 52, and lever 54. When lever 54 is in the position shown in FIG. 2, gasket 52 is held against valve seat 53, and the valve is closed. When lever 54 is moved in the direction of arrow B, valve stem 50 is pushed in the direction of arrow A, in a conventional manner through an intermediate connection between lever 54 and stem 50 (not shown). Gasket 52 "lifts" off of valve seat 53, and flow of beer is enabled. Beer flows through flow passageway 44, along the inner surface 56 of bellmouth 58, over valve seat 53, and out through nozzle 46.

Ideally, once dispensing set-up 10 has been installed, and tubes 30, which typically are food-grade polyethylene, are connected to kegs 20, pressure is then applied to the kegs 20. For purposes of simplicity, the set-up which will be considered is one in which only bottled carbon dioxide is used as the propellant. The pressure regulator(s) 26 are set to a specific pressure setting which is typically calculated or estimated during the process of installing the set-up. Typically, this pressure will be in the range of 9 to 24 pounds per square inch.

As previously mentioned, once pressure has been applied, the set-up may immediately depart from originally calculated performance. For example, it has been observed that the tubing 30 which carries the beer will begin to expand in diameter, as soon as pressure has been applied. This expansion is believed to continue, although perhaps at a steadily decreasing rate, for so long as the pressure is applied (i.e., continuously) . Although the static pressure in the tubes 30 falls off, each time lever 54 is actuated to release beer, simultaneously allowing the tubes 30 to begin to return toward their original diameter, recovery toward the original diameter is not instantaneous, and not complete. Accordingly, the system will be operating, in reality, with tubes 30 having greater diameters, and less back pressure, than designed for. Since many such dispensing systems are installed using general empirical design techniques, or even rough field estimation, trial and error techniques, such tube expansion may not be taken into account in the design and construction process.

As a rough cure for lower than expected back pressure, the proprietor or operator of the dispensing set-up will increase the carbon dioxide propellant pressure applied to the kegs 20, which may cause the beer to move too quickly through the tubing 30, particularly from flow passageway 44 into bellmouth 58, where the rapid pressure drop may cause foaming. Furthermore, when the beer is not flowing, the elevated carbon dioxide pressure will cause the beer to absorb the gas, ruining the taste of the beer, and giving the beer even more tendency to foam.

FIGS. 3–6 depict the apparatus according to the present invention (also shown in place in FIG. 2), which is intended to be a remedy for foaming problems in beer dispensing set-ups.

The apparatus comprises a substantially cylindrical coil 60 rolled from a single sheet 62 of mesh material. In a preferred embodiment of the invention, the mesh material is food grade 304 or 316 stainless steel, and may have a wire diameter of about 0.016 inches, although greater or lesser wire diameters are also possible. In an alternative embodiment of the invention, the mesh material may be a food grade plastic material, so long as the cross-sections of the "wires" of the mesh are round, and not flattened. The mesh may have a squares per linear inch count of 18 to 22 squares per linear inch. In a preferred embodiment of the invention, a mesh having 20 squares per linear inch is utilized. When sheet 62 is rolled to form coil 60, a central passage 64 may or may not be left remaining, depending upon the "length" of sheet 62 prior to rolling. In order to obtain coils having different diameters, to accommodate faucets 32 having different flow passageway diameters 44, sheet 62 may be formed of different lengths, or in an alternative embodiment, may be simply rolled more or less tightly. In this way, the flow control effect may be varied. As an alternative way to obtain varying degrees of flow control, the width (dimension "c" in FIG. 3) is varied; the wider sheet 62 is, the longer resultant coil 60 is, and the greater the degree of flow control. Preferably, the width "c" of sheet 62 (the length of coil 60) will range between 0.75" and 1.00". If the coil is significantly shorter, there will be insufficient surface area to have enough friction between the outside surface of coil 60 and the inner surface of flow passageway 44 to keep coil 60 properly inserted and in position. A length greater than one inch may be too large for most applications, and further may provide more added back pressure than would generally be needed. Flow control can also be affected by the mesh size, that is, the number of squares per inch. A more open mesh will provide a lesser amount of control than a more closed mesh.

Installation of a coil 60 is relatively simple. When a dispensing set-up is found to have deficient back pressure, or simply has a persistent foaming problem, the pressure is shut off, and the system is disconnected. The particular faucet head is removed and the internal diameter of flow passageway 44 checked. Once the proper diameter of coil 60 has been determined, trials are then run with different coils in place, beginning with an intermediate length or mesh density coil, which will add an intermediate amount of additional back pressure. It has been determined that, depending upon the original back pressure, and the applied pressure, the back pressure which coil 60 can add to the running system will be in the range of 2–14 pounds per square inch, depending upon the length and diameter of the coil 60, and the mesh size. After each coil 60 is installed, the system is run, and the quality and quantity of the flow is observed during a timed run. Through a process of interpolation, a proper size coil 60 can be found which will eliminate foaming at the point of exit from the faucet, but which will also permit an acceptable rate of flow, generally within five percent of one gallon per minute. The acceptable, non-foaming flowrate must be obtained without excessive applied pressure, which, as previously stated, would have the effect of contaminating the beer with excess absorbed carbon dioxide, when the beer stands, for example, overnight.

It has been observed, that in order for coil 60 to function, coil 60 must actually be inserted into flow passageway 44, and not only positioned so as to have an end positioned immediately at the transition point 64 between bellmouth 58 and flow passageway 44. For optimum effect, coil 60 should be completely inserted, as shown in FIG. 2.

As mentioned previously, every dispensing set-up is subject to degradation of performance throughout its entire lifetime. Even upon installation of a coil 60, according to the present invention, while the performance will be improved and made acceptable, the set-up will continue to degrade, prompting replacement of the particular coil used with a more flow restrictive coil. In order to prevent coil 60 from being inserted to far for removal, for replacement or for facilitating system cleaning, loop 66 is provided, which has an outside diameter which is greater than the diameter of flow passageway 44. In order to facilitate identification of the different sizes and grades of coils 60 by the installer, different shapes of loop 66 may be employed, such as heart-shaped loop 68 (FIG. 6), so as to enable each size and grade of coil 60 to be identified by a unique loop shape.

It is believed that through the installation of coils 60 into the faucets of a dispensing system, improved performance without resorting to the use of an expensive mixed gas propellant system, and extended useful life, before major replacement or reconstruction of the system, can be achieved.

The foregoing description and drawings merely serve to illustrate the invention and the invention is not limited thereto except insofar as the appended claims are so limited, as those skilled in the art who have the disclosure before them will be able to make modifications and variations therein without departing from the scope of the invention.

What is claimed is:

1. A beverage dispensing system for delivering and dispensing beverages having dissolved gases therein, under pressure, which beverages may tend to break up and release said dissolved gases in the form of foam, said beverage dispensing system comprising:

source means for storing said beverage in a substantially controlled environment;

at least one beverage transport member, operably associated with said source means, for transporting said beverage, under pressure, away from said source means;

at least one faucet means, operably associated with said at least one beverage transport member, for enabling delivery of said beverage into containers for consumption, said at least one faucet means including a shank portion, operably connected in fluid communication with said at least one beverage transport member, for receiving said beverage from said at least one beverage transport member and having a flow passageway disposed therein, a valve portion, operably configured to be selectively positionable between open and closed configurations, to start and stop flow of said beverage through said beverage dispensing system, and a nozzle portion, for directing flow of said beverage into said containers; and flow regulator means for substantially precluding the break-up of said beverage and release of said dissolved gases, so as to prevent foaming, said flow regulator means being operably arrangeable substantially within said shank portion of said at least one faucet means, including a flow regulator member, operably insertable into said flow passageway of said shank portion, upstream from a transition position between said shank portion and said valve portion of said at least one faucet means, said flow regulator member being in the form of a substantially cylindrical coil, with flow of said beverage being generally longitudinal through said coil, said coil having an axis extending substantially parallel to said flow passageway in said shank portion, said coil further having means for causing movement of the beverage through the coil in directions at least in part transverse to the flow passageway of said shank portion.

2. The beverage dispensing system according to claim 1, wherein said substantially cylindrical coil has an outer diameter advantageously configured so as to enable a slightly forced fit, upon insertion of said flow regulator member into said flow passageway of said shank portion of said at least one faucet means.

3. The beverage dispensing system according to claim 2, wherein said flow regulator member, and, in turn, said means for causing movement of the beverage further comprise:

a mesh member, advantageously configured to fit within said flow passageway of said shank portion of said at least one faucet means, with a slightly forced fit.

4. The beverage dispensing system according to claim 3, wherein said mesh member is fabricated from food grade stainless steel.

5. The beverage dispensing system according to claim 3, wherein said mesh member is formed from a substantially rectangular piece of mesh material.

6. The beverage dispensing system according to claim 5, wherein said mesh material has a wire thickness of 0.016 inches.

7. The beverage dispensing system according to claim 5, wherein said mesh material has a square per linear inch count in the range of 18 to 22 squares per linear inch.

8. An apparatus for substantially precluding foaming in a system for dispensing beverages having gases dissolved therein, in which the dispensing system includes source means for storing said beverage in a controlled environment; at least one beverage transport member, operably associated with said source means, for transporting said beverage, under pressure, away from said source means of beverage; at least one faucet means, operably associated with said at least one beverage transport member, for enabling delivery of said beverage into containers for consumption, said at least one faucet means including a shank portion, operably connected in fluid communication with said at least one beverage transport member, for receiving said beverage from said at least one beverage transport member, a valve portion, operably configured to be selectively positionable between open and closed configurations, to start and stop flow of said beverage through said beverage dispensing system, and a nozzle portion, for directing flow of said beverage into said containers, said apparatus comprising:

flow regulator mans for substantially precluding the break-up of said beverage and release of said dissolved gases, so as to prevent foaming, said flow regulator means operably arrangeable substantially within said shank portion of said at least one faucet means, including a flow regulator member, operably insertable into said flow passageway of said shank portion, upstream from a transition positon between said shank portion and said valve portion of said at least one faucet means, said flow regulator member being in the form of a substantially cylindrical coil, with flow of said beverage being generally longitudinal through said coil, said coil having an axis extending substantially parallel to said flow passageway in said shank portion, said coil further having means or causing movement of the beverage through the coil in directions at least in part transverse to the flow passageway of said shank portion.

9. The apparatus according to claim 8, wherein said substantially cylindrical coil has an outer diameter advantageously configured so as to enable a slightly forced fit, upon insertion of said flow regulator means into said flow passageway of said shank portion of said at least one faucet means.

10. The apparatus according to claim 9, wherein said flow regulator means and, in turn, said means for causing movement of the beverage further comprise:

a mesh member, advantageously configured to fit within said flow passageway of said shank portion of said at least one faucet means, with a slightly forced fit.

11. The apparatus according to claim 10, wherein said mesh member is fabricated from food grade stainless steel.

12. The apparatus according to claim 10, wherein said mesh member is formed from a substantially rectangular piece of mesh material.

13. The apparatus according to claim 12, wherein said mesh material has a wire thickness of 0.016 inches.

14. The apparatus according to claim 12, wherein said mesh material has a square count per linear inch in the range of 18 to 22 squares per linear inch.

15. The apparatus according to claim 9, wherein said flow regulator means further comprises:

handle means, operably emanating from an end of said coil, for facilitating removal of said flow regulator means from said flow passageway, and for substantially precluding overinsertion of said flow regulator means into said flow passageway.

16. The apparatus according to claim 15, wherein said handle means comprises:

a wire loop member, operably configured to form one of a plurality of particular geometric outlines, each said outline corresponding to a particular flow regulator means.

17. An apparatus for substantially precluding foaming in a system for dispensing beverages having gases dissolved therein, in which the dispensing system includes source means for storing said beverage in a controlled environment; at least one beverage transport member, operably associated with said source means, for transporting said beverage, under pressure, away from said source means of beverage; at least one faucet means, operably associated with said at least one beverage transport member, for enabling delivery of said beverage into containers for consumption, said at least one faucet means including a shank portion, operably connected in fluid communication with said at least one beverage transport member, for receiving said beverage from said at least one beverage transport member, a valve portion, operably configured to be selectively positionable between open and closed configurations, to start and stop flow of said beverage through said beverage dispensing system, and a nozzle portion, for directing flow of said beverage into said containers; said apparatus comprising:

flow regulator means for substantially precluding the break-up of said beverage and release of said dissolved gases, so as to prevent foaming, said flow regulator means being operably arrangeable substantially within said shank portion of said at least one faucet means, said flow regulator means including a flow regulator member being operably insertable into said flow passageway of said shank portion, upstream from a transition position between said shank portion and said valve portion of said at least one faucet means, said flow regulator member being in the form of a substantially cylindrical coil, said substantially cylindrical coil having an outer diameter advantageously configured so as to enable a slightly forced fit, upon insertion of said flow regulator means into said flow passageway of said shank portion of said at least one faucet means;

handle means, operably emanating from an end of said coil, for facilitating removal of said flow regulator means from said flow passageway, and for substantially precluding overinsertion of said flow regulator means into said flow passageway, said handle means including a wire loop member being operably configured to form one of a plurality of particular geometric outlines, each said outline corresponding to a particular flow regulator means.

* * * * *

UNITED STATES PATENT AND TRADEMARK OFFICE

CERTIFICATE OF CORRECTION

PATENT NO. : 5,368,205

DATED : November 29, 1994

INVENTOR(S) : James K. Groh

It is certified that error appears in the above-indentified patent and that said Letters Patent is hereby corrected as shown below:

| | |
|---|---|
| Col. 1, Line 24 | Underline "and" |
| Col. 7, Line 62 | After "system" insert — , —. |
| Col. 9, Line 24 | After "regulator" delete "mans" and insert — means —. |

Signed and Sealed this

Ninth Day of May, 1995

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,368,205
DATED : November 29, 1994
INVENTOR(S) : James K. Groh

It is certified that error appears in the above-indentified patent and that said Letters Patent is hereby corrected as shown below:

Col. 3, Line 37 After "is" insert — to —.

Signed and Sealed this
Fourth Day of July, 1995

*Attest:*

*Attesting Officer*

BRUCE LEHMAN

*Commissioner of Patents and Trademarks*